US007918968B1

(12) United States Patent
Baker et al.

(10) Patent No.: US 7,918,968 B1
(45) **Date of Patent: *Apr. 5, 2011**

(54) APPARATUS FOR CLEANING PAPER MACHINE PRESS FABRICS ON-THE-RUN

(75) Inventors: Gary Baker, Union, KY (US); David Kelso, Thunderbay (CA)

(73) Assignee: Dubois Chemicals, Inc., Sharonville, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/951,109

(22) Filed: Nov. 22, 2010

Related U.S. Application Data

(60) Continuation of application No. 12/572,561, filed on Oct. 2, 2009, now Pat. No. 7,850,824, which is a division of application No. 11/548,454, filed on Oct. 11, 2006, now Pat. No. 7,597,782.

(51) Int. Cl.
*D21G 3/00* (2006.01)

(52) U.S. Cl. ..... 162/272; 162/199

(58) Field of Classification Search ..... 162/272, 162/275, 199; 134/184
See application file for complete search history.

(56) References Cited

U.S. PATENT DOCUMENTS 5,783,044 A * 7/1998 Schneider et al. ..... 162/278
6,364,959 B1 * 4/2002 Straub et al. ..... 134/9
6,517,682 B2 * 2/2003 Hendriks et al. ..... 162/199

* cited by examiner

*Primary Examiner* — Mark Halpern
(74) *Attorney, Agent, or Firm* — Jones Day

(57) ABSTRACT

An apparatus is described for cleaning papermaking felt by applying a low concentration of a cleaning solution through the oscillating needle nozzles. The detergent is applied intermittently while paper is being manufactured. Each cleaning period lasts for at least the length of time required for the nozzles to cover the entire surface of the felt, and preferably twice that period of time. The application of cleaning solution is then discontinued for a period of time. This cycle is repeated continuously as the paper is being manufactured. The apparatus includes a first cleaning chemical reservoir, a second cleaning chemical reservoir, a high pressure pump coupled to the first and second reservoirs, and a control unit having programming for selectively injecting the chemicals.

10 Claims, 1 Drawing Sheet

APPARATUS FOR CLEANING PAPER MACHINE PRESS FABRICS ON-THE-RUN

CROSS-REFERENCE TO RELATED APPLICATIONS

This application is a continuation of U.S. patent application Ser. No. 12/572,561, filed Oct. 02, 2009, now U.S. Pat. No. 7,850,824, which is a divisional of U.S. patent application Ser. No. 11/548,454, filed Oct. 11, 2006, now U.S. Pat. No. 7,597,782, which is incorporated by reference.

BACKGROUND

Generally, the paper manufacturing process employs a machine that systematically de-waters a pulp slurry which consists largely of cellulose wood fibers, along with various chemical additives used as fillers and functional components of the paper or paper products. The pulp is prepared from various species of wood, by basically either of two pulping methods: chemical digestion to separate the cellulose fibers from lignin and other natural organic binders, or by mechanical grinding and refining. The resulting cellulose fibers are used in the manufacture of paper products whereby the pulp is supplied to a paper machine system, slurried in water to various solids levels (consistency), and ultimately diluted to about 0.5-1.0% solids for subsequent de-watering to form a sheet of paper. The low consistency of solids is necessary in order to facilitate fast drainage on the former while achieving proper fiber-to-fiber contact and orientation in the sheet. De-watering begins on the former, which is a synthetic wire or mesh that permits drainage to form a wet-web.

The web is then transferred into the machine press section and is squeezed between roller nips and synthetic press felts (predominantly comprised of nylon) to further remove water, and then through a dryer section comprised of steam-heated roller cans. Finally, the sheet is wound onto a reel. Other process stages can include on-machine surface sizing, coating, and/or calendaring to impart functional paper characteristics.

Generally, the wet-web is approximately 20% solids coming off of the former, 40% solids after leaving the press section, and about 94-97% solids (3-6% moisture) as the paper on the reel. Various chemical compounds are added to the fiber slurry to impart certain functional properties, to different types of paper. Fillers such as clay, talc, titanium dioxide, and calcium carbonate may be added to the slurry to impart opacity, improve brightness, improve sheet printing, substitute for more expensive fiber, improve sheet smoothness, and improve overall paper quality. Also, various organic compounds are added to the fiber slurry to further enhance paper characteristics. These include: sizing agents (either acid rosin, or alkaline AKD or ASA) to improve sheet printing so the ink doesn't bleed through the sheet, starch for internal fiber bonding strength, retention aids to help hold or bind the inorganic fillers and cellulose fines in the sheet, brightening compounds, dyes, etc. Therefore, as the sheet is de-watered on the paper machine, many types of deposits can result on the papermaking equipment. These deposits result from the chemicals used in the process, along with the natural wood compounds that are not thoroughly removed from pulping processes, or from inclusion of recycled fiber in the pulp slurry, and as a result of water re-use.

The primary function of the press-felt fabrics (other than a means of sheet conveyance) is to aid in the de-watering process of the wet-web. The press felts act like blotters or sponges that receive water that is expressed from the web by the pressure of the roller nips. On most modern paper machines, the water is then removed from the press felts by vacuum elements in the press, consisting of the Uhle boxes and suction press rolls. The press felts return in their travel loop back to the nip, to continually receive and transport water away from the web. Consequently, the press felts become contaminated with various types of soils resulting from the web compounds, and from the process shower waters used to flush the felts. Additionally, available chlorine is used in the treatment of paper machine press shower waters, which are used for felt washing and conditioning, in order to prevent microbial growths that result in slime formation that subsequently causes plugging of the shower nozzles. The residual chlorine, however, is detrimental to the nylon press fabrics. Over-treatment, or long-term accumulative effects of available chlorine can cause attack of the polyamide to the point where felt fiber shedding occurs, and press felt integrity is lost. Not only does this cause premature wear, and shorten the useful life of the press felt, but the fractured nylon fibers that become loosened from the felts contaminate the paper.

Additionally, if the paper is surface treated in the manufacturing process, i.e., on-machine coated or sized, these surface treatment systems become contaminated with the nylon-felt fibers, by transference. Sheet defects can become predominant, as manifested in "blade scratches", when felt fibers are "snagged" by a blade coater.

Prior felt washing methods, used during the papermaking process, have relied upon dedicated chemical showers. There are four basic types of felt showers. Flooding showers are low pressure, high volume showers that flush loose particles and maintain the evenness of the water distribution in the felt. These are most effective at removing contaminants when used in conjunction with the nip of an inside felt carrying roll and require adequate vacuum to remove water volume. Flooding showers are used in tissue applications and on bleed-thru prone fine paper pickup felts.

Lubricating showers are low pressure, low volume shower used to apply a thin lubricating film of water to the felt prior to contact with a suction box to reduce wear and friction and act as a seal for the suction box. These showers apply a fan spray into the nip of the suction box with an overlapping coverage.

Chemical showers are low pressure, lower volume showers used to apply chemicals to the felt. These are most effective at removing contaminants when used in conjunction with the nip of an inside felt carrying roll. For maximum efficiency/dwell time, this shower should be placed as close to the sheet felt split and as far from the suction box as possible.

High Pressure showers are low volume showers used to physically dislodge contaminants from the felt. These are most efficient when placed close to a supporting roll.

High pressure cleaning of felts is best accomplished with an oscillating needle jet at controlled pressures. Proper oscillation of the high-pressure shower to assure uniform felt coverage is essential to an efficient felt conditioning system. Improper shower oscillation can result in a streaky felt appearance. Some sections of the felt do not receive showering and become filled while other sections of the felt receive partial or uniform showering.

All modern paper machine press sections are equipped with high pressure oscillating needle showers, just prior to the Uhle or vacuum box, as standard equipment from the machine manufacturer. These showers are provided as a means of mechanical cleaning, in order to both "chisel" away surface deposits and to loosen soils deep within the press felts void volume or base cloth. As an example, the oscillating needle showers may operate at pressures typically in the range of 150-250 psi, equipped with 0.040" orifice spray nozzles, which are space 3"-6" apart. These showers are designed to oscillate so as to allow the needle jets to cover the entire cross-machine direction of the press felt. The oscillation speed should ideally be matched to the rotation frequency of the press felt, so as to cover a cross-machine directional distance equal to the nozzle jet diameter, i.e., 0.040", within the time of one nip rotation of the fabric (typically 2-4 seconds). Additionally, the shower oscillation stroke distance is often twice the needle-jet shower spacing, in order to obtain double full spray coverage of the felt. This is to compensate for a possible spray void area, should a nozzle become plugged.

Although chemicals have been applied to felts using high pressure showers at low part per million concentrations, these chemicals were limited to "conditioners" or preventative soil agents applied on a continuous basis. The high operating pressure of the needle poses difficulty in achieving sufficient cleaner concentrations to achieve adequate soil removal, so as to restore felt void-volume sufficiently, to improve felt permeability and water transport in a short period of time, such as 10-60 minutes per cleaning application. Applying sufficient cleaning composition to the felt on a continuous bases is cost prohibitive.

Further cleaning press fabrics "on-the-run", while manufacturing paper, by injecting a detergent cleaner into the intrinsic high-pressure oscillating needle showers of a press felt, so as to remove papermaking soils for maintaining adequate press fabric de-watering, must be accomplished without adding water to the press, without disrupting the papermaking process (sheet breaks), and without causing off-quality product or sheet defects. Thus, high pressure showers have not been used for remedial or restorative chemical cleaning of press felt.

SUMMARY

The present invention encompasses application of the cleaning agent to the high pressure oscillating needle showers on a pulsed basis, with sufficient cleaning duration so as to apply full detergent coverage across the entire press fabric. The addition of cleaning agent is then discontinued for a period of time and then repeated. The cleaning agent(s) may be applied in proportion to press fabric mass, among the various press felt position on a given machine, so as to cost-optimize a press felt cleaning program.

Moreover, although applied wash time is an important parameter to consider for any on-the-run washing method, not only in light of reaction time of the cleaning chemistry upon different soil types at a given concentration, it is preferable that the wash duration will be at least equal to the period of time required to achieve full coverage of the needle jets' oscillation, as described earlier. The minimum duration of a single wash period is a function the felt rotation speed, versus the oscillation speed of the high-pressure needle shower. Preferably, the wash period should last long enough to achieve "double full coverage" by the needle jets. The wash period can be any multiple of the full coverage period.

Moreover, the washing event can be repeated multiple times over the course of a day, everyday, as needed, in order to remove soils and optimize upon the fabrics de-watering capability. Hence, use of a timer, or preferably a PLC can be used for multiple, daily wash events to optimize the press felt cleaning program.

Preferably, more than one chemical cleaning agent is administered, during a cleaning cycle or during alternate cleaning cycles. For example one can alternate between an alkaline and acidic detergent, in order to optimize cleaning efficacy for a variety of soil types.

DETAILED DESCRIPTION

Figure 1:
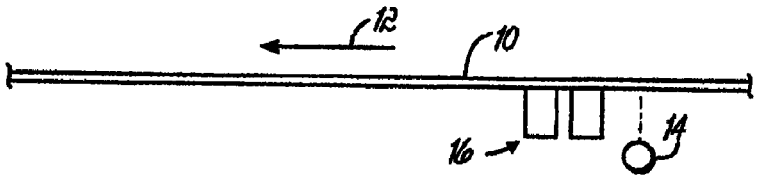
FIG. 1 is a diagrammatic view of a press felt run partially broken away.

FIG. 1 shows an exemplary view of a portion of a run of a papermaking felt. In this embodiment, the felt 10 runs in the direction of arrows 12 over various rollers (not shown). A high pressure oscillating needle shower 14 applies chemical to felt 10 immediately upstream of double UHLE box 16. The particular location of the high pressure shower is a matter of choice. Further, various low pressure showers are typically used to treat the felt 10. The selection and location of these is determined by the particular application, and forms no portion of the present invention.

Figure 2:
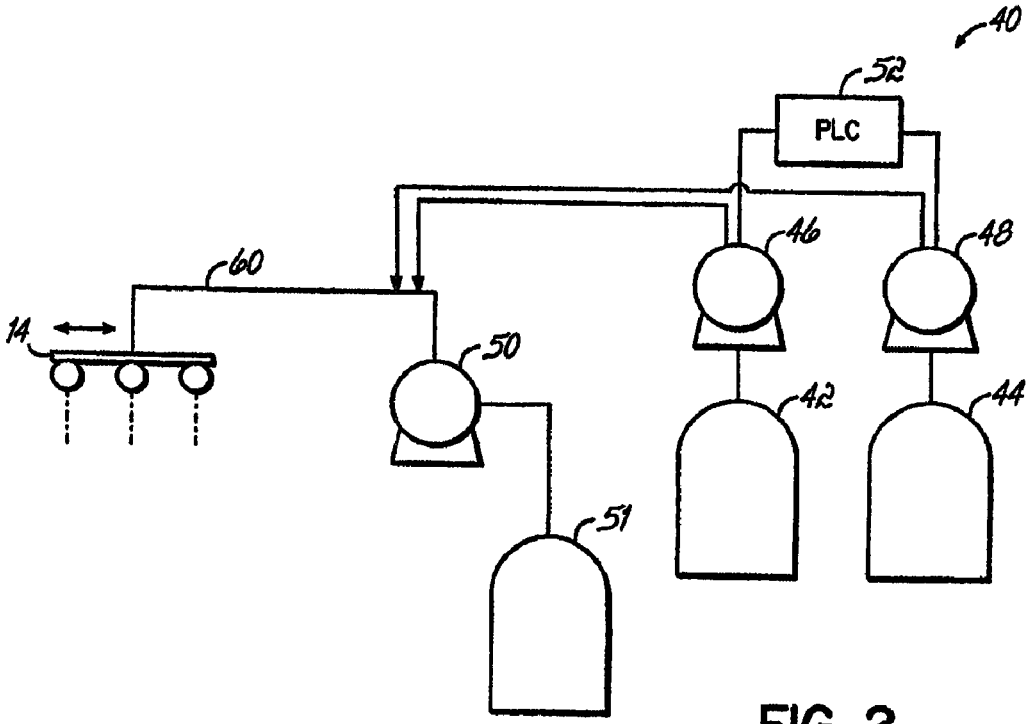
FIG. 2 is a diagrammatic depiction of the system used to feed cleaning agents to an oscillating needle shower.

Further, as shown in FIG. 2, a chemical feed system 40 includes apparatus to introduce one or more cleaning fluids into the high pressure flow of liquid to the oscillating shower 14. As shown in FIG. 2, there are two cleaning chemical reservoirs 42 and 44 both with pumps 46 and 48 used to draw cleaning solution from reservoirs 42 and 44 and direct these upstream of a high pressure pump 50 which directs liquid, generally water, from a reservoir 51 or other source to the needle shower 14. Pumps 46 and 48 are controlled by a PLC 52 which controls the amount of chemical pumped as well as the timing of the introduction of the chemicals, as discussed below.

Although FIG. 2 shows two chemical reservoirs 42 and 44, it is possible to have only one chemical reservoir with one pump, or, alternately, three or more selected chemicals. However, the selection of two chemicals, as discussed below, is preferred.

According to the present invention, a cleaning chemical is forced through the high pressure needle nozzles 14 as paper is being manufactured. However, the chemicals are introduced on an intermittent basis.

As discussed above, the needle showers produce a very small, approximately 0.04 inch diameter, spray of water at a very high pressure, generally 150 to 250 psi, directly against the felt. Typically, the oscillating needle showers include a series of the needle nozzles spaced 3 inches to 6 inches apart, each with a 0.04 inch spray diameter. Thus, at any one time, the needle shower contacts only a small portion of the felt. Therefore, the nozzles are oscillated back and forth as the felt moves. Over a period of time, which depends upon the speed of the felt and the speed of the oscillation, the entire felt will be uniformly contacted with the spray from the needle showers. This period of time is referred to hereinafter as the full coverage period.

The needle showers themselves are operated continuously during the entire period of time that paper is being manufactured. Therefore, any time that the felt is moving, the needle showers should be applying the high pressure spray of material against the felt, and should be oscillating back and forth to ensure full coverage.

A cleaning solution is added intermittently through the needle showers as paper is being manufactured. The cleaning solution must be injected through the nozzles for a period of time at least equal to the full coverage period, and, preferably, for twice the full coverage period. This ensures that the entire felt is contacted with the cleaning solution. Subsequent to this period of time, the addition of the cleaning solution through the needle shower is discontinued. However, the papermaking process and the application of water without cleaning solution through the needle nozzle continues.

The actual duration of the full coverage period depends upon the felt rotation speed so as to achieve full coverage with the oscillating needle shower (the stroke timed to speed matching of the felt rpm per 0.040 inches movement). For a four felted machine at higher operating speeds, i.e., 3000-3600 fpm, the cleaning solution feed is on for about 15 minutes maximum each hour. This provides for double full coverage.

For a three-felted machine at the same speed, 20 minutes per hour is sufficient. For slower speeds, i.e., 2200-2800 fpm, 24 minutes of treatment each hour is optimal. Generally, the minimum off time between cleaning applications will be at least one full coverage period. The inactive time, i.e., the period of time between cleaning times, should be no longer than 50 minutes. If the period of time between cleaning is too long, too much soil will fill the felt. Applying the cleaning chemical operation at least once per hour causes a cumulative effect on the felt providing significant cleaning for the felt.

The cleaning solution used in the present invention can be any cleaning solution typically employed to clean papermaking felt. Depending upon the chemistry of the particular equipment, these cleaning compositions can be alkaline, acid, anionic, or nonionic. Therefore, one will select one or more cleaning compositions, based on the particular papermaking operation. Generally, they will include, in addition to surfactants and the requisite acid or base wetting agents, chelants and sequestrants. Exemplary formulations for both acid and alkaline cleaning compositions are set out below (parts by weight).

| Alkaline felt wash | |
|---|---|
| water | 63.4-73.4 |
| potassium hydroxide | 15.0-20.0 |
| complex phosphate | 5.0-15.0 |
| surfactant amphoteric | 0.1-0.75 |
| chelant | 2.0-5.0 |
| sequestrant | 0.2-1.0 |

| Acidic felt wash | |
|---|---|
| water | 66.0-78.0 |
| organic acid (acetic) | 10.0-20.0 |
| phosphoric acid sequestrant | 5.0-15.0 |
| surfactant amphoteric | 1.0-4.0 |
| glycol ether solvent | 2.0-8.0 |
| chlorine scavenger | 0.05-0.25 |

The chemical compositions are generally added at about 200 to 600 ppm on a 100% actives basis. The detergent compositions themselves, however, are generally diluted and contain about 15-20% actives.

Since the total amount of soil which is deposited within a press fabric is basically proportional to the felt area, and since all press fabrics on a given machine are the same width (differing by their length), then the amount of press felt cleaner for each press felt can optimally be applied in proportion to the fabric's length, to achieve the same degree of cleanliness. It is best to adjust the concentration of the detergent applied to each felt based upon relative length and soil loading, rather than adjusting detergent feed duration. If the detergent feed duration were varied proportionally in the following example, the coverage of the oscillating needed shower coverage would not result in uniform application of the cleaner. For instance, for a given tri-nip press on a fine paper machine, the Pickup, first bottom press, and third top press felts all have a width of 320", and the following lengths respectively: 76', 55.5' and 46 feet. Thus, in proportion to their area, the press felts would be allocated approximately: 43%, 31% and 26% respectively, of the daily detergent allotment.

In a preferred embodiment, two different cleaning agents are applied alternately with spaced time intervals between the applications. As shown in FIG. 2, in a preferred embodiment the two different cleaning agents, one alkaline the other acid, or, alternately, one anionic and one nonionic, or one alkaline or acid and the second one neutral, are applied by apparatus 40 shown in FIG. 2. In this embodiment, the two different chemicals are stored in reservoirs 42 and 44 controlled by pumps 46 and 48, which, in turn, are controlled by a PLC 52. Pumps 46 and 48 inject the chemical into the inlet line 60 between the pump 50 and the needle shower 32. In a preferred embodiment, one of the cleaning solutions is applied for a period of time, preferably equal to twice the full coverage period. The PLC will discontinue the flow of the cleaning solution for a period of time, generally for the remaining portion of the hour. Next, the PLC will inject the second cleaning solution through the needle shower 14, preferably for twice the full coverage period. The PLC will then discontinue application of cleaning solution for a period of time. This will be repeated continuously while the papermaking machine is producing paper.

The invention will be further appreciated in light of the following example.

EXAMPLE

Improved Paper Machine Sheet Quality, Runability, and Yield

A test was performed on a fine paper machine equipped with a Twin-ver press, plus straight-through third press and smoothing press, which produced light and medium basis weight free sheet paper grades. Previously, this machine had attempted to enact soils prevention by use of a cleaner continuously, through the high-pressure showers, with insufficient results. As a result, downtime cleaning of the press fabrics (no paper being manufactured on the reel) was required with an alkaline detergent. This not only caused loss of paper production, but also led to culled production during manufacturing, due to sheet defects that occurred in between the intervals of downtime washing events. These defects, i.e., corrugations, wrinkles, and ridges were caused by variation in cross-direction (CD) moisture content of the sheet. This was caused by soiling of the press felts, and due to the fact that no "on-the-run" felt washing capability was available to correct the problem. Additionally, no machine moisture adjustments were available other than dry weight headbox control.

The test consisted of application of alternating two cleaning compounds through the high pressure showers of each press fabric at various frequencies and durations, and measuring the effects upon felt Uhle box vacuums, press filtrate de-watering rates, press felt water permeability profiles, press felt service life, sheet quality, and machine runnability and up-time. The best results were observed when an acid and alkaline cleaner were alternated every other hour, at the rate of 24 minutes on and 36 minutes off, each hour (12 feed cycles each, per day), at a concentration in the range of 0.12-0.15%. This novel cleaning program resulted in huge improvements to the paper machine's production and quality yield, buy lowering CD sheet moisture variation (improvement in reel-shape, and fewer sheet breaks during felt washing). The overall results of the new cleaning program were as follows:

The trial machine monthly total losses for wrinkles were reduced to 19.1 Tons during the 4-month trial period, from 58.2 Tons (pre-trial) and a monthly average of 54.3 tons. Annualized this would result in a reduction of cull loss for wrinkles of 469.2 Tons.

The trial machine monthly total losses for ridges was reduced to 7.8 Tons during the 4 month trial period, from 71.1 Tons (Pre-trial) and a monthly average of 34.8 tons. Annualized this would result in a reduction of cull losses for ridges of 759.6 Tons.

The trial machine monthly total losses for corrugations was reduced to 41.5 Tons during the 4-month trial period, from 65.6 Tons (Pre-trial) and a monthly average of 38.8 tons. Annualized this would result in a reduction in culls for corrugations of 289.2 Tons.

The sum total of estimated reductions in annual culls for ridges, wrinkles and corrugations is 1,518 Tons for this trial machine.

Total cull losses for ridges, wrinkles, and corrugations on the trial machine's winder and super calendar were substantially lower in almost every category, during the trial period.

The present invention, when compared to standard cleaning methods, provided significant improvement in water permeability of the press fabric over its entire service life. There was, further, a significant reduction in the vacuum as measured at the UHLE box.

Further, alternating alkaline and acidic cleaners utilizing the method of the present invention further provided significantly improved results versus using only alkaline or only acidic cleaners. Hence, alternating cleaning chemistry types can increase felt void volume and improve felt dewatering performance over the useful life of the felt.

Further, due to the fact that the present invention uses relatively low concentration of cleaning solution, generally around 0.2 percent, whereas a standard cleaner might be used at a much higher rate, such as 3 percent, has relatively no impact on paper quality. Thus, the cleaning can be conducted while paper is being manufactured without causing sheet defects or sheet breaks. Further, since a relatively small amount of cleaning is applied, there is minimal impact on the cost of the paper. Further, the cost in chemicals is significantly less than the expense occurred in down time required to clean the felt off line.

This has been a description of the present invention along with the preferred method of practicing the invention. However, the invention itself should only be defined by the appended claims.

What is claimed is:

1. An apparatus for cleaning paper machine press fabric on a paper machine, the apparatus comprising:

a nozzle configured to spray liquid onto the fabric;

a source of a first cleaning liquid;

a source of a second cleaning liquid that is different from the first cleaning liquid;

a hydraulic system configured to direct flows of the first and second cleaning liquids from the sources to the nozzle for spraying onto the fabric; and a timer configured to operate the hydraulic system to direct a flow of the second cleaning liquid to the nozzle intermittently while directing a flow of the first cleaning liquid to the nozzle continuously.

2. The apparatus of claim 1 wherein the first cleaning liquid includes water without a cleaning chemical and the second cleaning liquid includes a cleaning chemical.

3. The apparatus of claim 1 wherein the timer is configured to operate the hydraulic system to direct a flow of the first cleaning liquid to the nozzle continuously throughout multiple full coverage periods for the fabric, and to direct a flow of the second cleaning liquid to the nozzle intermittently in applications that each have a duration of at least one full coverage period.

4. The apparatus of claim 1 wherein the timer is configured to operate the hydraulic system to direct a flow of the first cleaning liquid to the nozzle continuously throughout multiple full coverage periods for the fabric, and to direct a flow of the second cleaning liquid to the nozzle intermittently in applications that are separated by a time off period of at least one full coverage period.

5. The apparatus of claim 4 wherein the intermittent applications of the second cleaning liquid include applications that each have a duration of at least one full coverage period.

6. The apparatus of claim 1 wherein the sources of the first and second cleaning liquids are reservoirs that are separate from each other.

7. The apparatus of claim 1 wherein the hydraulic system includes a pump configured to draw the second cleaning liquid from the source of the second cleaning liquid.

8. The apparatus of claim 7 wherein the hydraulic system includes an additional pump configured to draw the first cleaning liquid from the source of the first cleaning liquid.

9. The apparatus of claim 1 wherein the source of the first cleaning liquid is a reservoir.

10. The apparatus of claim 1 wherein the nozzle is an oscillating nozzle.

* * * * *